US010544369B2

(12) United States Patent
Bulbuc et al.

(10) Patent No.: US 10,544,369 B2
(45) Date of Patent: Jan. 28, 2020

(54) SUPERCRITICAL BITUMEN FROTH TREATMENT FROM OIL SAND

(71) Applicant: SYNCRUDE CANADA LTD. in trust for the owners of the Syncrude Project as such owners exist now and in the future, Fort McMurray (CA)

(72) Inventors: Daniel Bulbuc, Sherwood Park (CA); Keng Chung, Edmonton (CA); David Childs, Edmonton (CA)

(73) Assignee: SYNCRUDE CANADA LTD, in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 396 days.

(21) Appl. No.: 14/995,106

(22) Filed: Jan. 13, 2016

(65) Prior Publication Data

US 2016/0208174 A1 Jul. 21, 2016

Related U.S. Application Data

(60) Provisional application No. 62/103,436, filed on Jan. 14, 2015.

(51) Int. Cl.
*C10G 1/00* (2006.01)
*C10G 1/04* (2006.01)

(52) U.S. Cl.
CPC ..... *C10G 1/045* (2013.01); *C10G 1/047* (2013.01)

(58) Field of Classification Search
CPC ..... C10G 1/04; C10G 1/045; C10G 1/047; C10G 21/003; C10G 21/02; C10G 21/06;
(Continued)

(56) References Cited

U.S. PATENT DOCUMENTS 7,597,794 B2 10/2009 Zhao et al.
9,296,954 B2 * 3/2016 Yuan ..... C10G 1/045
(Continued)

FOREIGN PATENT DOCUMENTS

CA 2524995 C 1/2007
CA 02746987 * 1/2012

OTHER PUBLICATIONS

Deo et al., Supercritical fluid extraction of a crude oil, bitumen-derived liquid and bitumen by carbon dioxide and propane, Fuel vol. 71, pp. 1519-1526 (Year: 1992).*
(Continued)

*Primary Examiner* — Prem C Singh
*Assistant Examiner* — Brandi M Doyle
(74) *Attorney, Agent, or Firm* — Bennett Jones LLP

(57) ABSTRACT

A process for treating a bitumen froth comprising bitumen, solids and water to produce a deasphalted oil product is provided comprising optionally diluting the raw bitumen froth with a diluent to form a diluted bitumen froth; separating the raw or diluted bitumen froth into a light bitumen fraction and a heavy bitumen fraction comprising bitumen, fine solids and water; mixing the heavy bitumen fraction with a first solvent to form a solvent/bitumen mixture; and introducing the solvent/bitumen mixture into a first extraction vessel operating at a temperature and a pressure such that the solvent is at or near supercritical conditions to form a heavy phase comprising asphaltenes, solids and water and a light phase comprising deasphalted oil.

8 Claims, 5 Drawing Sheets

(58) Field of Classification Search
CPC ..... C10G 21/12; C10G 21/14; C10G 21/16; C10G 21/28; C10G 21/30
See application file for complete search history.

(56) References Cited

U.S. PATENT DOCUMENTS

| | | | | |
|---|---|---|---|---|
| 2013/0098806 | A1* | 4/2013 | Hollander | C10G 1/045 208/391 |
| 2014/0138287 | A1* | 5/2014 | De Klerk | C10G 55/04 208/390 |
| 2014/0238905 | A1* | 8/2014 | Dunn | C10G 31/08 208/391 |
| 2014/0346088 | A1* | 11/2014 | Yuan | C10G 1/045 208/390 |

OTHER PUBLICATIONS

Chakma, Supercritical extraction of tar sands bitumen, Rev. High Pressure Sci. Technolo., vol. 7, pp. 1389-1394 (Year: 1998).*

* cited by examiner

SUPERCRITICAL BITUMEN FROTH TREATMENT FROM OIL SAND

FIELD OF THE INVENTION

The present invention relates generally to a bitumen froth treatment process for removing contaminants, namely water, asphaltenes and particulate solids, to produce a variety of deasphalted oil (DAO) products which can be directly upgraded in a conventional oil refinery.

BACKGROUND OF THE INVENTION

Oil sand, as known in the Athabasca region of Alberta, Canada, comprises water-wet, coarse sand grains having flecks of a viscous hydrocarbon, known as bitumen, trapped between the sand grains. The water sheaths surrounding the sand grains contain very fine clay particles. Thus, a sample of oil sand, for example, might comprise 70% by weight sand, 14% fines, 5% water and 11% bitumen. (All % values stated in this specification are to be understood to be % by weight.) The bitumen recovered from Athabasca oil sand is generally very viscous and has an API gravity of less than 10 due to the large amount of heavy ends, such as residue and asphaltenes.

For the past 25 years, the bitumen in Athabasca oil sand has been commercially recovered using a water-based process. In the first step of this process, the oil sand is slurried with process water, naturally entrained air and, optionally, caustic (NaOH). The slurry is mixed, for example in a tumbler or pipeline, for a prescribed retention time, to initiate a preliminary separation or dispersal of the bitumen and solids and to induce air bubbles to contact and aerate the bitumen. This step is referred to as "conditioning".

The conditioned slurry is then further diluted with flood water and introduced into a large, open-topped, conical-bottomed, cylindrical vessel (termed a primary separation vessel or "PSV"). The diluted slurry is retained in the PSV under quiescent conditions for a prescribed retention period. During this period, aerated bitumen rises and forms a froth layer, which overflows the top lip of the vessel and is conveyed away in a launder. Sand grains sink and are concentrated in the conical bottom. They leave the bottom of the vessel as a wet tailings stream containing a small amount of bitumen. Middlings, a watery mixture containing solids and bitumen, extend between the froth and sand layers.

The wet tailings and middlings are separately withdrawn, combined and sent to a secondary flotation process. This secondary flotation process is commonly carried out in a deep cone vessel wherein air is sparged into the vessel to assist with flotation. This vessel is referred to as the TOR vessel. The bitumen recovered by flotation in the TOR vessel is recycled to the PSV. The middlings from the deep cone vessel are further processed in induced air flotation cells to recover contained bitumen.

The froths produced by the PSV and flotation cells are then combined and subjected to further froth cleaning, i.e., removal of entrained water and solids, prior to upgrading. Typically, bitumen froth comprises about 60% bitumen, 30% water and 10% solids. It is understood, however, that these values can vary depending upon the grade (e.g., bitumen content and/or fines content) of the mined oil sand ore. There are currently two commercially proven processes to clean bitumen froth. One process involves dilution of the bitumen froth with a naphtha solvent, followed by bitumen separation in a sequence of scroll and disc centrifuges. Alternatively, the naphtha diluted bitumen may be subjected to gravity separation in a series of inclined plate separators ("IPS") in conjunction with countercurrent solvent extraction using added naphtha, or some combination of both.

While the hydrocarbon recovery is very high when using naphtha dilution (~98%), there remains an undesirable amount of contaminants in the product bitumen comprised of mostly solids and water (e.g., 1% and 2%, respectively) and asphaltenes. It is understood that these values can vary depending upon the quality of the bitumen froth. These contaminants contained therein pose a risk to the downstream upgrading operation; the chlorides in the residual water present a corrosion risk to processing equipment while the solids and asphaltenes foul the upgrading equipment and reduce catalyst life. Thus, the majority of the bitumen product must first be upgraded using fluid coking units. The requirement to thermally crack the majority of this product stream comes with additional drawbacks in the last phase of the upgrading process (e.g., hydrotreating/hydroprocessing); the thermally cracked coker products now require significantly higher catalyst addition rates due to fouling of the catalyst active sites, hydrotreating intensity requirements are much higher for cracked product streams and more hydrogen per barrel of feed is required to complete the final upgrading step. Finally, the conventional froth treatment naphtha process produces Fluid Fine Tailings (FFT), which is difficult to reclaim, and has significant losses of solvent (naphtha) to the tailings pond.

The other commercial process involves diluting the bitumen froth with a paraffinic solvent, for instance a mixture of iso-pentane and n-pentane, followed by gravity separation. When paraffinic solvent is used, a portion of the asphaltenes in the bitumen is also rejected by design, thus achieving solid and water levels that are lower than those in the naphtha-based froth treatment. Thus, some of the product streams by-pass the fluid coker primary upgrading step. Also, a moderate reduction in hydrotreating intensity would be expected in processing partially DAO product streams.

However, with the paraffinic process there is a much lower hydrocarbon recovery (~92%), with significant losses of volatile solvent (pentane) to tailings. The process also produces FFT, which, as mentioned, is difficult to reclaim.

SUMMARY OF THE INVENTION

Broadly stated, in one aspect of the invention, a process is provided for treating bitumen froth whereby a deasphalted oil (DAO) product is produced that qualifies as "fungible bitumen", i.e., bitumen of a pipelineable quality, which is suitable for upgrading in most conventional refineries. More particularly, a process for treating a bitumen froth comprising bitumen, solids and water to produce a deasphalted oil product is provided, comprising:

- optionally diluting the raw bitumen froth with a diluent to form a diluted bitumen froth;
- separating the raw or diluent bitumen froth into a light bitumen fraction and a heavy bitumen fraction comprising heavy bitumen, solids and water;
- mixing the heavy bitumen fraction with a first solvent to form a solvent/bitumen mixture; and
- introducing the solvent/bitumen mixture into a first extraction vessel operating at a temperature and a pressure such that the first solvent is at or near supercritical conditions to form a heavy phase comprising asphaltenes, solids and water and a light phase comprising deasphalted oil.

In one embodiment, a solvent is added to the raw or diluted bitumen froth and the raw or diluted bitumen froth is separated in an extraction vessel operating at a temperature and a pressure so that the solvent is at or near supercritical conditions.

As used herein, "diluent" generally refers to a hydrocarbon diluent such as naphtha or paraffin.

In one embodiment, the solvents useful for supercritical extraction includes $CO_2$, water, toluene, methanol, naphtha, $C_3$ to $C_5$ alkanes and the like and mixtures thereof. In one embodiment, the solvents are $C_4$ and $C_5$ alkanes and mixtures thereof. Generally, extraction vessels of the present invention are operated at a temperature of about 32-250° C. and at a pressure of about 3-24 MPa so that the solvent acts as a supercritical solvent or an "anti-solvent". Of course, it is understood that the temperature and pressure of the extraction vessel will depend upon the solvent or solvent mixture used, as well as the solids concentration present.

The term "supercritical solvent" or "anti-solvent" means a solvent or mixture of solvents in a supercritical state whereby the solvent (or mixture of solvents) exhibits properties of both a gas and a liquid; liquid-like in terms of its density and gas-like in terms of its diffusivity and viscosity.

It was discovered that certain solvents at supercritical state disrupt the solubility of asphaltenes (and to some extent maltenes) and essentially cause the bitumen to reject them.

In one embodiment, the asphaltene-solids by-product is processed in a fluid or delayed coker, or a gasifier. In another embodiment, the asphaltene-solids by-product can be processed in a combustor for steam or power production. In another embodiment, the asphaltene by-product can be stockpiled for future use.

One or more of the following advantages may be realized when practicing an embodiment of the invention:

- DAO product(s) may qualify as "fungible bitumen" and can be available for direct sale;
- most of the DAO products do not require thermal conversion;
- DAO product(s) requires less intensive hydrotreating and therefore provides a benefit of a significant reduction in $H_2$ uptake per barrel and lower catalyst deactivation rate;
- majority of the DAO products have a very low fouling propensity and result in significantly reduced catalyst deactivation rates and lower net catalyst addition rates in downstream hydroprocessors;
- $CO_2$ emissions per barrel may be reduced by as much as 40% compared to conventional upgrading operations;
- significant reduction in tailings volume and overall hydrocarbon losses to tailings; and
- elimination of FFT production from the conventional froth treatment processes.

DESCRIPTION OF THE PREFERRED EMBODIMENT

In one aspect, the invention is concerned with a process for treating a bitumen froth comprising bitumen, solids and water to produce a deasphalted oil product, thereby eliminating the need for extensive bitumen froth cleanup. A cleaner product, e.g., less solids and water, is produced for upgrading which reduces many of the problems associated with the conventional froth treatment processes utilizing naphtha as a diluent. Further, the hydrocarbon losses are less than when using the paraffinic froth treatment process.

Figure 1:
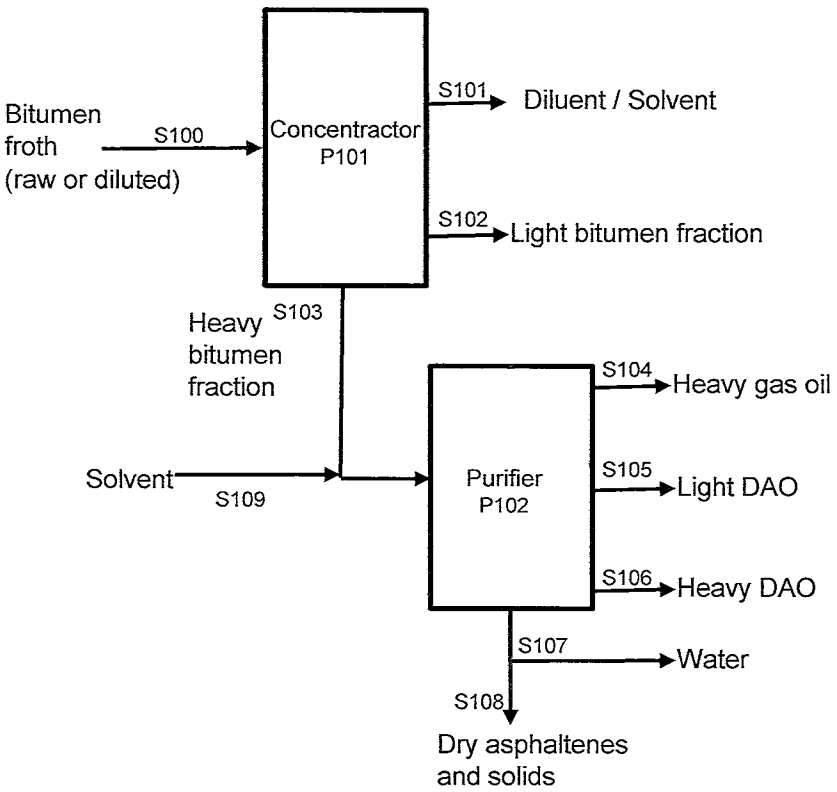
FIG. 1 is a schematic showing one embodiment of the components and steps of the process.

With reference now to FIG. 1, bitumen froth is initially received from an extraction plant (not shown) for extracting bitumen from oil sands using a water extraction process known in the art. The froth, as received, typically comprises 60% bitumen, 30% water and 10% solids. It is understood, however, that these values can vary depending upon the grade (e.g., bitumen content and/or fines content) of the mined oil sand ore. Bitumen froth S100 may be used in the form of raw bitumen froth or may be first diluted with a diluent such as naphtha or other solvent prior to further treatment (referred to herein as "diluted bitumen froth").

Figure 2:
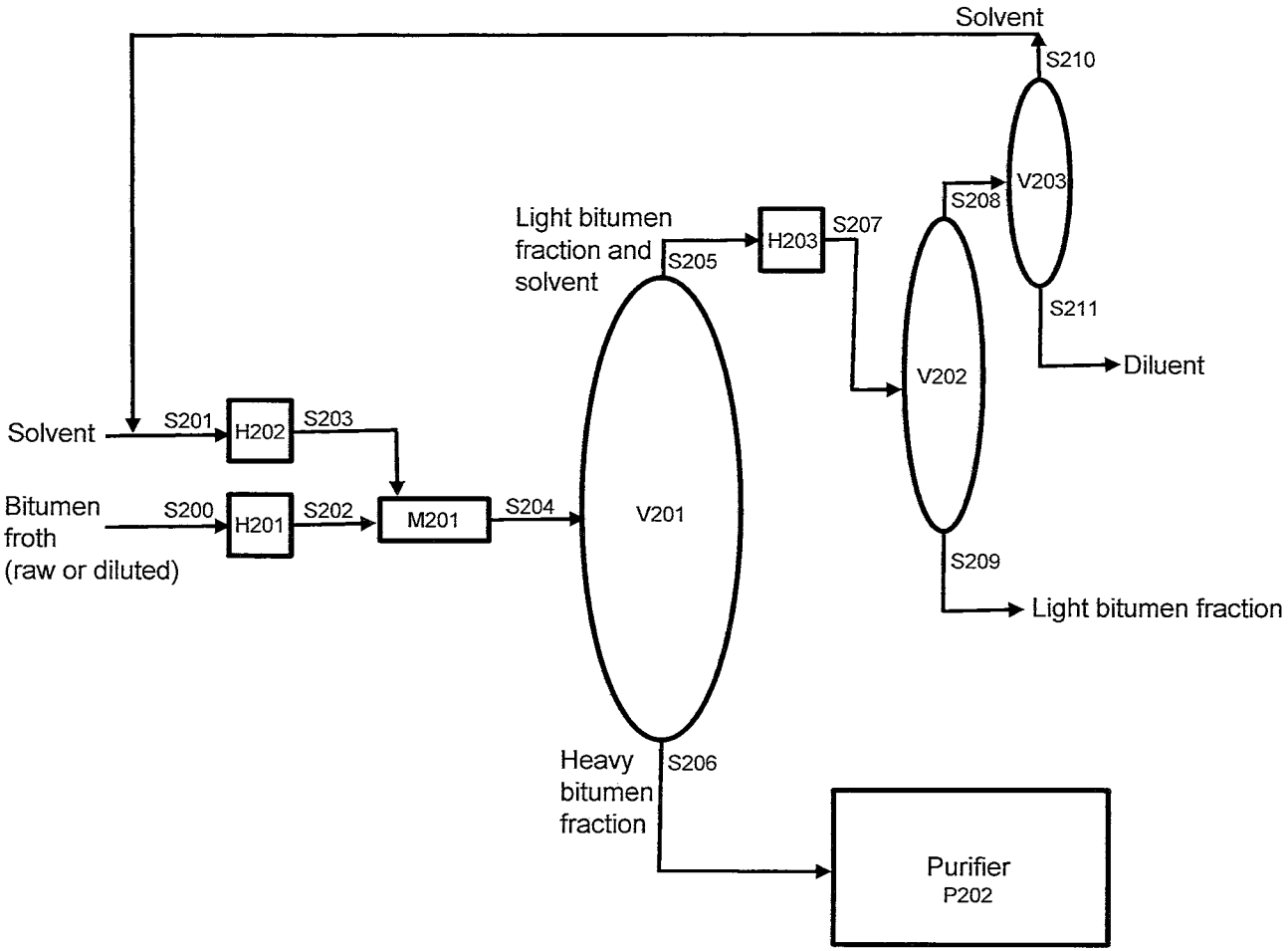
FIG. 2 is a schematic showing another embodiment of the components and steps of the process.

The raw or diluted bitumen froth (bitumen froth S100) is introduced into a separation vessel (Concentrator P101), which Concentrator may be a supercritical solvent extraction process, which is described in more detail in FIG. 2. In the Concentrator P101, the feed is separated into at least two products, a light bitumen fraction S102 and a heavy bitumen fraction S103 comprising bitumen components, fine solids and water. If diluted bitumen froth is used or if a solvent is used and the separation vessel also acts as an extraction vessel, a third product may be produced, namely, a diluent/solvent stream S101. The diluent/solvent stream S101 can be reused to dilute more bitumen froth from the oil sands extraction plant (not shown). The light bitumen fraction S102 can be further treated, if needed be, in hydrotreating/hydroprocessing units (not shown).

The heavy bitumen fraction S103 and a solvent S109 (which may include $CO_2$, water, toluene, methanol, naphtha, $C_3$ to $C_5$ alkanes or mixtures) is introduced into an extraction vessel (Purifier P102), which Purifier operates at a particular temperature and pressure so that the vessel operates as a supercritical solvent extraction vessel. Thus, the solvent S109 acts as a supercritical solvent to separate the components present in the heavy bitumen fraction S103. For example, if the solvent is $CO_2$, extraction conditions are above the critical temperature of 31° C. and critical pressure of 74 bar.

In the Purifier P102, the heavy bitumen fraction S103 may be separated into a variety of deasphalted oil (DAO) products, if needed be, such as a heavy gas oil S104, a light DAO S105 and a heavy DAO S106, and byproduct streams of a dry asphaltenes-solids S108 and water S107. The DAO products can be further treated, if needed be, in hydroprocessing units or refinery processing units. The by-product water S107 can be reused in the oil sands operations. The by-product asphaltenes-solids S108 can be processed in a fluid or delayed coker, or a gasifier, or a combustor for steam or power production. The by-product asphaltenes-solids S108 can also be stockpiled for future use.

In one embodiment, as shown in FIG. 2, the Concentrator Step may be practiced as follows. Raw or diluted bitumen froth S200 is first introduced to a heating device H201 (which may include a heater or heat exchanger) and heated to a desired temperature. A solvent S201 (which may include $CO_2$, water, toluene, methanol, naphtha, $C_3$ to $C_5$ alkanes or mixtures) is introduced to a heating device H202 (which may be a heater or heat exchanger) and heated to a desired temperature. The heated bitumen froth S202 and heated solvent S203 are fed through a mixing device M201 (which may be an in-line mixer) and the mixture S204 is introduced to an extraction vessel V201, which is operated at an elevated temperature and pressure. It is understood that extraction vessel V201 will be operated at a temperature and pressure such that the heated solvent S203 acts as a supercritical solvent, i.e., the condition of the solvent of the mixture is at or near the supercritical state. In the extraction vessel V201, the feed is separated into two products, a light bitumen fraction S205 (which may also include diluent and solvent) and a heavy bitumen fraction S206 comprising bitumen, fine solids and water. The latter is fed to another extraction vessel, Purifier P202, for further treatment as shown in FIG. 3.

The light bitumen fraction S205 is removed from the top of the extraction vessel V201 and fed to a heating device H203 (which may be a heater or heat exchanger) and heated to a desired temperature. The heated light bitumen fraction S207 is introduced into an extraction vessel V202, where light bitumen fraction S209 (comprises light gas oil) is produced. Light gas oil can be further treated, if need be, in a hydrotreating unit (not shown). The overhead stream S208, which may comprise diluent and solvent, of the extraction vessel V202 is introduced to a separating device V203 (which may be a fractionator or splitter). A stream of solvent S210 is produced which can be reused as solvent stream S201 to dilute more bitumen froth. A diluent stream S211 (if using diluted bitumen froth) is also produced which can be reused to dilute bitumen froth from the extraction process (not shown).

Figure 3:
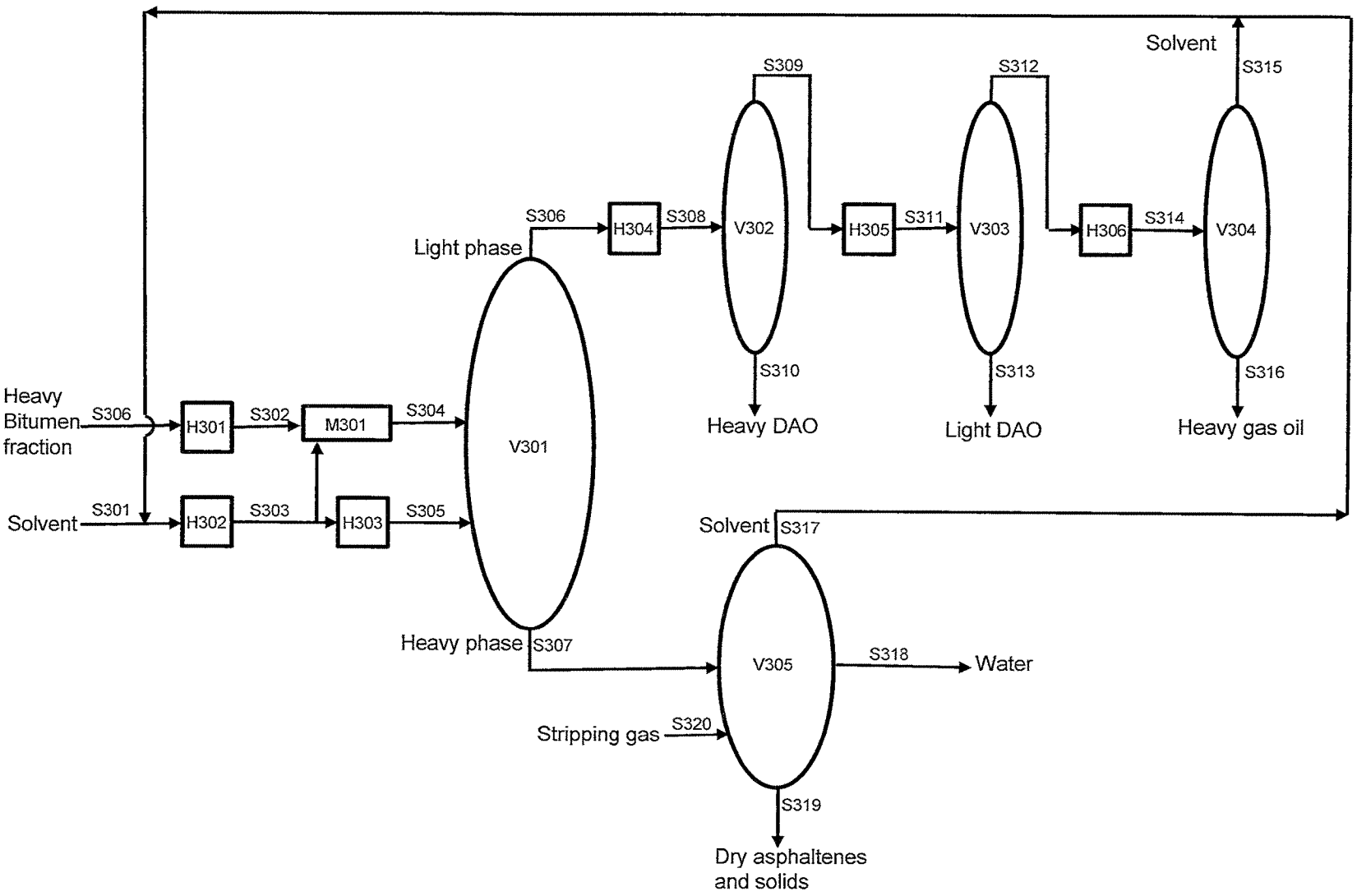
FIG. 3 is a schematic showing another embodiment of the components and steps of the process.

In one embodiment, as shown in FIG. 3, the heavy bitumen fraction S306, which is produced in extraction vessel V201, is subjected to a purifier step. Heavy bitumen fraction S206 is introduced as heavy bitumen fraction S306 to a heating device H301 (which may include a heater or heat exchanger) and heated to a desired temperature. A solvent S301 (which may include $CO_2$, water, toluene, methanol, naphtha, $C_4$, $C_5$ alkane for example, isobutene, butane, pentane and isopentane or mixtures thereof) is introduced to a heating device H302 (which may be a heater or heat exchanger) and heated to a desired temperature. The heated heavy bitumen fraction S302 and heated solvent S303 are fed through a mixing device M301 (which may be an in-line mixer) and the mixture S304 is introduced to an extraction vessel V301, which, in one embodiment, comprises no internals, such as an open column. The extraction vessel V301 is operated at an elevated temperature and pressure. The condition of the solvent of the mixture is at or near the supercritical state. The remainder of heated solvent S303 is introduced to a heating device H303 (which may be a heater or heat exchanger) and heated to a desired temperature such that the solvent is at or near the supercritical state. Additional supercritical solvent S305 is fed, as required, to the lower section of extraction vessel V301. The overall solvent to bitumen ratio, by volume, in the extraction vessel V301 can range from 1.5:1 to 10:1, preferably 1.5:1 to 7:1, more preferable 2:1 to 5:1. The temperature of the extraction vessel V301 can be controlled at approximately between 32° C. and 250° C. with a pressure range of approximately 3 to 24 MPa, depending upon the supercritical solvent used.

In the extraction vessel V301, the feed is separated into two phases: a light phase S306 comprising solvent and extractable oil product and containing primarily oils and resins and a heavy phase S307 comprising the asphaltenes by-product, which contains most of the organometallics and coke-forming carbonaceous matters, fine solids, water and some solvent.

In one embodiment, as shown in FIG. 3, the light phase S306 is introduced to a heating device H304 (which may include a heater or heat exchanger) and heated to a desired temperature. The heated light phase S308 is fed to an extraction vessel V302 operating at an elevated temperature and pressure, where a heavy DAO S310 is produced. The remaining light phase S309 is removed from the top of extraction vessel V302 and is fed to a heating device H305 (which may include a heater or heat exchanger) and heated to a desired temperature. The heated remaining light phase S311 is fed to an extraction vessel V303 operating at an elevated temperature and pressure, where a light DAO S313 is produced. The remaining light phase S312 is removed from the top of extraction vessel V303 and is fed to a heating device H306 (which may include a heater or heat exchanger) and heated to a desired temperature. The heated remaining light phase S314 is fed to an extraction vessel V304 operating at an elevated temperature and pressure, where a heavy gas oil S316 is produced. A stream of solvent S315 is produced from the top of extraction vessel V304, which can be reused as solvent stream S301 to process more heavy bitumen fraction in V301.

In one embodiment, as shown in FIG. 3, the heavy phase S307 is introduced to a vapor-solids separator V305 (referred to as asphaltenes-solids granulation process). A stripping gas S320 (which may include steam, nitrogen gas, natural gas and the like that are non-reactive with the components of heavy phase S307) is introduced to the lower section of separator V305. In the separator V305, a dry fine asphaltenes-solids mixture S319 is produced, which can be utilized directly as solid fuel or stockpiled. The stripping gas S320 displaces the solvent entrained in the fine asphaltenes-solids mixture S319, resulting in solvent S317 recovery from the top of separator V305, which can be reused as solvent stream S301 to process the heavy bitumen fraction. The water S318 produced from the separator V305 can be reused in the oil sands operations.

Figure 4:
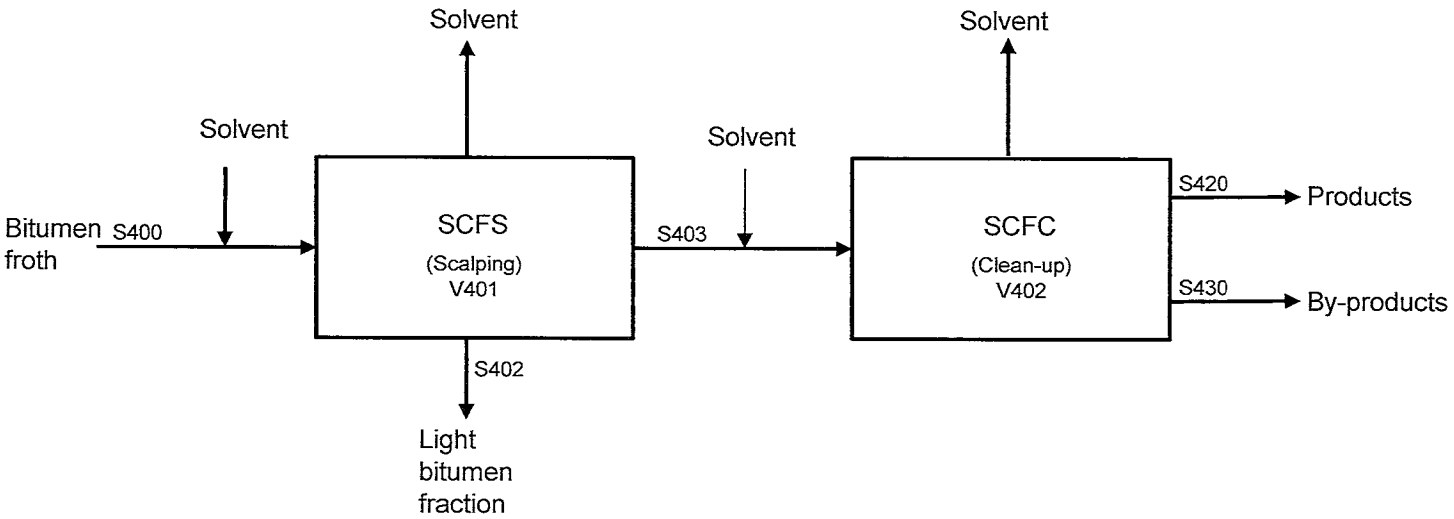
FIG. 4 is a schematic showing another embodiment of the components and steps of the process.

In another embodiment shown in FIG. 4, which process is referred to as supercritical scalping and cleanup, bitumen froth S400 is added directly to a first extraction vessel V401, thereby by-passing the concentrator shown in FIG. 1. Supercritical solvent is added to the bitumen froth prior to it entering the first extraction vessel V401, which vessel is operated at an elevated temperature and pressure to maintain supercritical conditions. This first extraction stage is also referred to as supercritical fluid scalping, or SCFS. In this first stage, both light ends (light bitumen fraction) S402 and some solvent are separated from the rest of the components of the bitumen froth, resulting in heavy ends (heavy bitumen fraction) S403 comprising heavy bitumen, fine solids, asphaltenes and water. Supercritical solvent is added to heavy ends S403 and the mixture enters a second extraction vessel V402, which vessel is also operated at an elevated temperature and pressure to maintain supercritical conditions. This second stage is referred to supercritical cleanup, or SCFC. In this stage, a deasphalted oil (DAO) (Stream S420 is produced (Products) and a dry asphaltenes-solids and water (Stream S430) are produced (By-products). Both the DAO Products and the By-products can be further treated as discussed above.

Figure 5:
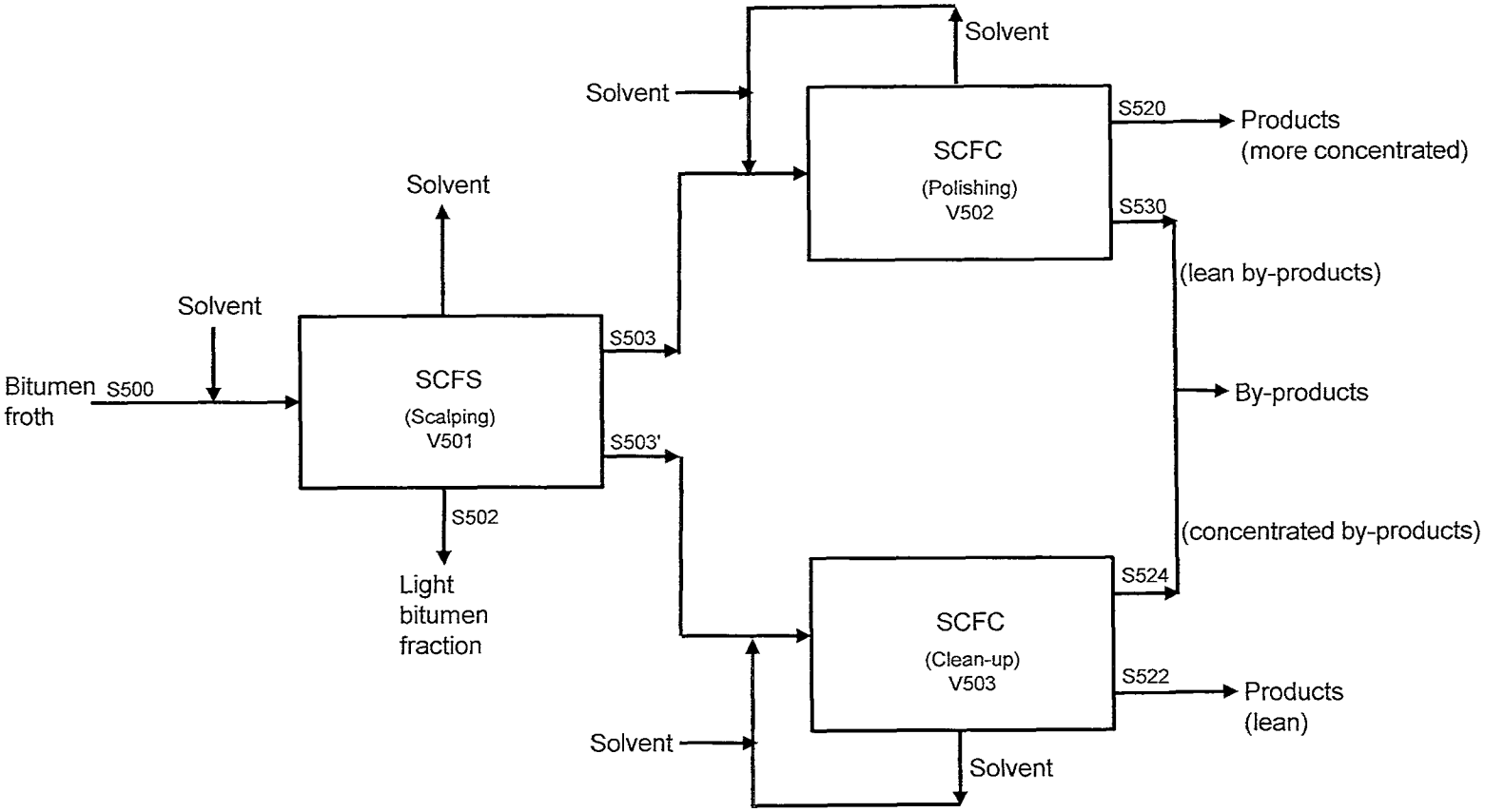
FIG. 5 is a schematic showing another embodiment of the components and steps of the process.

In another embodiment shown in FIG. 5, a supercritical scalping, polishing and clean-up process is illustrated. In this embodiment, bitumen froth S500 is added directly to a first extraction vessel V501, thus, also by-passing the concentrator shown in FIG. 1. Supercritical solvent is added to the bitumen froth prior to the froth entering the first extraction vessel V501 and first extraction vessel V501 is operated at an elevated temperature and pressure to maintain supercritical conditions. In this first extraction stage, (referred to a supercritical fluid scalping) both light ends S502 (light bitumen fraction) and some solvent are separated, and two partially treated heavy bitumen streams are produced, a first heavy ends stream S503 with a small amount of by-product and a second heavy ends stream S503' with a small amount of oil product. Additional supercritical solvent is added to the first heavy ends stream S503 and the first heavy ends stream S503 is then treated in a second extraction vessel V502 (referred to as supercritical fluid polishing), which vessel is also operated at an elevated temperature and pressure to maintain supercritical conditions. A deasphalted oil (DAO) (Stream S520) is produced (Products) and some dry asphaltenes-solids and water (Stream S530) are produced (By-products). Both the DAO Products and the By-products can be further treated as discussed above.

Additional supercritical solvent is added to the second heavy ends stream S503' and the second heavy ends stream S503' is then treated in a third extraction vessel V503 (referred to as supercritical fluid clean-up), which vessel is also operated at an elevated temperature and pressure to maintain supercritical conditions. Some deasphalted oil (DAO) (Stream S522) is produced (Products) and most of the dry asphaltenes-solids and water (Stream S524) are produced (By products). Both the DAO Products and the By-products can be further treated as discussed above.

The supercritical solvent can be recovered from all three extraction vessels and reused in the process.

EXAMPLE 1

Small scale batch experiments were performed using Supercritical $CO_2$ with and without co-solvents that included water, naphtha, toluene, methanol, pentane and mixtures thereof, to determine the solubility of bitumen in the supercritical fluid. Table 1 shows the solubility data obtained using supercritical $CO_2$ with different co-solvents at 60° C. and 20 MPa. Replicate experiments were performed for each case.

TABLE 1

Solubility of Bitumen in Different Supercritical Fluids

| Solvents | Solubility (g/g) Trial #1 | Trial #2 |
|---|---|---|
| $CO_2$ | 0.01 | 0.009 |
| $CO_2$ + water | 0.012 | 0.011 |
| $CO_2$ + n-pentane | 0.019 | 0.012 |
| $CO_2$ + naphtha | 0.016 | 0.022 |
| $CO_2$ + toluene | 0.018 | 0.016 |
| $CO_2$ + methanol | 0.03 | 0.026 |
| $CO_2$ + methanol + toluene | 0.028 | 0.027 |
| $CO_2$ + methanol + toluene + water | 0.015 | 0.017 |

Table 1 shows that of the solvents tested, bitumen was most soluble in the supercritical mixture of $CO_2$, methanol and toluene, which suggests that this combination of solvents would work well in a supercritical froth treatment process.

EXAMPLE 2

The following table was published in Reid, Robert C., J. M. Prausnitz, and Bruce E. Poling. 1987. The Properties of Gases and Liquids. New York: McGraw-Hill and gives critical properties for components commonly used as supercritical fluids.

TABLE 2

Critical properties for some components commonly used as supercritical fluids
Critical properties of various solvents (Reid et al., 1987)

| Solvent | Molecular weight (g/mol) | Critical temperature (K) | Critical pressure MPa (atm) | Critical density (g/cm$^3$) |
|---|---|---|---|---|
| Carbon dioxide ($CO_2$) | 44.01 | 304.1 | 7.38 (72.8) | 0.469 |
| Water ($H_2O$) (ace. IAPWS) | 18.015 | 647.096 | 22.064 (217.755) | 0.322 |
| Methane ($CH_4$) | 16.04 | 190.4 | 4.60 (45.4) | 0.162 |
| Ethane ($C_2H_6$) | 30.07 | 305.3 | 4.87 (48.1) | 0.203 |
| Propane ($C_3H_8$) | 44.09 | 369.8 | 4.25 (41.9) | 0.217 |
| Ethylene ($C_2H_4$) | 28.05 | 282.4 | 5.04 (49.7) | 0.215 |
| Propylene ($C_3H_6$) | 42.08 | 364.9 | 4.60 (45.4) | 0.232 |
| Methanol ($CH_3OH$) | 32.04 | 512.6 | 8.09 (79.8) | 0.272 |
| Ethanol ($C_2H_5OH$) | 46.07 | 513.9 | 6.14 (60.6) | 0.276 |
| Acetone ($C_3H_6O$) | 58.08 | 508.1 | 4.70 (46.4) | 0.278 |

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for treating a bitumen froth comprising bitumen, solids and water to produce a deasphalted oil product, comprising:

mixing the bitumen froth with a first solvent to form a first mixture;

introducing the first mixture to a first extraction vessel operating at a temperature and a pressure such that the first solvent is at or near supercritical conditions to form a light bitumen fraction, first heavy ends stream comprising primarily heavy bitumen and a second heavy ends stream comprising primarily asphaltenes-solids and water;

mixing the first heavy ends stream with a second solvent selected from the group consisting of $CO_2$, water, toluene, methanol, naphtha, and combinations thereof to form a second mixture;

introducing the second mixture to a second extraction vessel operating at a temperature and a pressure such that the second solvent is at or near supercritical conditions to separate asphaltenes and fine solids and water from the heavy bitumen to form a first deasphalted oil product and a first dry asphaltenes-solids and water by-products;

mixing the second heavy ends stream with a third solvent to form a third mixture; and introducing the third mixture to a third extraction vessel operating at a temperature and a pressure so that the third solvent is at or near supercritical conditions to separate asphaltenes and fine solids from residual heavy bitumen to form a second deasphalted oil product and a second dry asphaltenes-solids and water by-products.

2. The process as claimed in claim 1, wherein the first solvent is selected from the group consisting of $CO_2$, water, toluene, methanol, naphtha, $C_3$ to $C_5$ alkanes and combinations thereof.

3. The process as claimed in claim 1, wherein the second solvent consists of $CO_2$ and either water, toluene, methanol, naphtha, or combinations thereof.

4. The process as claimed in claim 1, wherein the third solvent is selected from the group consisting of $CO_2$, water, toluene, methanol, naphtha, $C_3$ to $C_5$ alkanes and combinations thereof.

5. The process as claimed in claim 1, wherein the first solvent, second solvent and third solvent are the same.

6. The process as claimed in claim 1, wherein the first extraction vessel, second extraction vessel and third extraction vessel are each operated at a temperature ranging from 32° C. to 250° C. and a pressure ranging from 3 MPa to 24 MPa.

7. The process as claimed in claim 1, wherein the second solvent comprises $CO_2$.

8. The process as claimed in claim 1, wherein both the first solvent and the second solvent comprises $CO_2$.

* * * * *